US010879631B2

(12) United States Patent
Sato et al.

(10) Patent No.: US 10,879,631 B2
(45) Date of Patent: Dec. 29, 2020

(54) ELECTRIC WIRE WITH TERMINAL AND METHOD OF MANUFACTURING THE SAME

(71) Applicant: YAZAKI CORPORATION, Tokyo (JP)

(72) Inventors: Tomoya Sato, Shizuoka (JP); Naoki Ito, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/507,980

(22) Filed: Jul. 10, 2019

(65) Prior Publication Data

US 2020/0021045 A1 Jan. 16, 2020

(30) Foreign Application Priority Data

Jul. 13, 2018 (JP) ..... 2018-132876

(51) Int. Cl.
*H01R 4/64* (2006.01)
*H01R 43/02* (2006.01)
*H01R 4/02* (2006.01)

(52) U.S. Cl.
CPC ..... *H01R 4/646* (2013.01); *H01R 4/023* (2013.01); *H01R 43/0207* (2013.01)

(58) Field of Classification Search
CPC .... B23K 20/10; H01R 4/646; H01R 43/0207; H01R 4/023; H01R 11/11
USPC ..... 439/874, 83, 430; 29/860
See application file for complete search history.

(56) References Cited

U.S. PATENT DOCUMENTS 3,360,850 A * 1/1968 Avila ..... B23K 20/103 228/110.1
5,947,364 A * 9/1999 Tamura ..... B23K 20/106 156/580.2
5,989,370 A * 11/1999 Wannebo ..... B29C 65/086 156/290
7,374,466 B2 * 5/2008 Onuma ..... H01R 11/28 439/874

(Continued)

FOREIGN PATENT DOCUMENTS

CN 104112913 A 10/2014
DE 10 2014 004 127 A1 9/2015

(Continued)

*Primary Examiner* — Travis S Chambers
(74) *Attorney, Agent, or Firm* — Kenealy Vaidya LLP

(57) ABSTRACT

An electric wire with a terminal and manufacturing method thereof is provided. In the electric wire with the terminal, the protective member, the core wire, and the terminal fitting are integrally connected to each other by ultrasonic vibration applied via the protective member from an ultrasonic horn in a state in which the core wire is sandwiched between the protective member and the terminal fitting. Therefore, there is no possibility that the ultrasonic horn directly presses the core wire, and the edge (particularly, the rear edge) of the pressing portion of the ultrasonic horn is direct in contact with the core wire. Thereby, at the time of ultrasonic bonding, stress concentration due to the edge (particularly the rear edge) of the pressing portion of the ultrasonic horn with respect to the core wire can be relaxed, and disconnection of the core wire can be suppressed.

9 Claims, 12 Drawing Sheets

(56) References Cited

U.S. PATENT DOCUMENTS

| | | | | |
|---|---|---|---|---|
| 9,011,188 | B2 * | 4/2015 | Aoki | H01R 4/023<br>439/874 |
| 2009/0229880 | A1 * | 9/2009 | Watanabe | H01R 4/183<br>174/72 A |
| 2010/0003867 | A1 * | 1/2010 | Lehmann | H01R 4/187<br>439/874 |
| 2010/0248559 | A1 * | 9/2010 | Fukase | H01R 4/185<br>439/878 |
| 2012/0111629 | A1 * | 5/2012 | Patrikios | H01R 43/0207<br>174/74 R |
| 2014/0312097 | A1 | 10/2014 | Miyazato et al. | |
| 2014/0353361 | A1 * | 12/2014 | Numata | H01R 43/0207<br>228/110.1 |

FOREIGN PATENT DOCUMENTS

| | | | |
|---|---|---|---|
| JP | 11-317118 | A | 11/1999 |
| JP | 2016-4762 | A | 1/2016 |
| JP | 2016-78093 | A | 5/2016 |

* cited by examiner

ELECTRIC WIRE WITH TERMINAL AND METHOD OF MANUFACTURING THE SAME

CROSS-REFERENCE TO RELATED APPLICATIONS

This application is based on and claims priority under 35 USC 119 from Japanese Patent Application No. 2018-132876 filed on Jul. 13, 2018, the contents of which are incorporated herein by reference.

TECHNICAL FIELD

The present invention relates to an electric wire with a terminal formed by ultrasonically bonding a terminal to a core wire exposed to an electric wire terminal, and a method of manufacturing the same.

BACKGROUND ART

As an electric wire with a terminal in the related art in which the terminal is connected to a core wire by ultrasonic bonding, an electric wire with a terminal described in the following patent document is known.

In the electric wire with the terminal, as shown in FIG. 12, a core wire 102 of a terminal-processed electric wire 101 is sandwiched between a plate-like terminal fitting 103 placed on an anvil 104 and an ultrasonic horn 105, and the core wire 102 and the terminal fitting 103 are connected by applying ultrasonic vibration in a pressurized state.

PRIOR ART DOCUMENT

Patent Document

Patent Document 1: JP-A-2016-004762

SUMMARY OF INVENTION

However, in the case of the conventional electric wire with the terminal, an edge 105*a* of the ultrasonic horn 105 is in direct contact with the core wire 102. Therefore, at the time of pressurization accompanying the ultrasonic bonding, stress concentration due to the edge 105*a* of the ultrasonic horn 105 may occur in the shear direction of the core wire 102, and a part (strand) 102*a* of the core wire 102 may be disconnected (see a partially enlarged view in FIG. 12).

The present invention was devised focusing on such technical problems, and an object of the present invention is to provide an electric wire with a terminal capable of suppressing disconnection of a core wire during ultrasonic bonding and a method of manufacturing the same.

The present invention is an electric wire with a terminal in which the core wire exposed from the end of the electric wire is connected to the terminal by ultrasonic bonding. In one aspect, the core wire is integrally connected to a protective member and the terminal by ultrasonic vibration applied in a pressurized state from the ultrasonic horn via the protective member in a state of being sandwiched between the protective member and the terminal.

In another aspect of the electric wire with a terminal, it is desired that a dimension of the protective member is preferably set to be substantially the same as a dimension of a distal end portion of the ultrasonic horn that is in contact with the protective member in a direction orthogonal to the core wire and orthogonal to the pressurization direction.

In this way, since the width dimension of the protective member is set to be substantially the same as the width dimension of the distal end portion of the ultrasonic horn, the core wire can be protected without excess or deficiency in the width direction of the protective member.

In still another aspect of the electric wire with a terminal, it is desired that the dimension of the protective member is preferably equal to or larger than a dimension of the distal end portion of the ultrasonic horn that is in contact with the protective member minus the diameter of the strand of the core wire and is equal to or smaller than the dimension of the distal end portion of the ultrasonic horn in the direction orthogonal to the core wire and orthogonal to the pressurization direction.

In this way, since the lower limit of the width dimension of the protective member is obtained by subtracting the diameter of the core wire from the width dimension of the distal end portion of the ultrasonic horn, the wires (all strands) constituting the core wire overlap with the protective member in the width direction of the protective member, and the strands of the core wire do not protrude from the protective member. As a result, the disconnection of the core wire can be effectively suppressed.

Further, since the upper limit of the width dimension of the protective member is set to the width dimension of the distal end portion of the ultrasonic horn, the surplus portion of the protective member is reduced, and the yield of the material of the protective member can be improved. As a result, the manufacturing cost of the electric wire with a terminal can be reduced.

In still another aspect of the electric wire with a terminal, the dimension of the protective member is preferably ⅔ or more of the dimension of the distal end portion of the ultrasonic horn that is in contact with the protective member, and smaller than the dimension of the distal end portion of the ultrasonic horn in the direction orthogonal to the core wire and orthogonal to the pressurization direction.

When the core wire is pressurized by the ultrasonic horn, stress concentration is likely to occur in a region of ⅔ of the dimension of the distal end portion of the ultrasonic horn having a large crushing margin, in particular. Therefore, since the lower limit of the width dimension of the protective member is set to ⅔ of the width dimension of the distal end portion of the ultrasonic horn, it is possible to protect the region where the stress concentration is likely to occur by the protective member while suppressing the material cost of the protective member. As a result, both the suppression of the disconnection of the core wire and the reduction of the manufacturing cost (material cost of the protective member) can be achieved.

Further, since the width dimension of the protective member is set to be equal to or greater than ⅔ of the width dimension of the distal end portion of the ultrasonic horn and smaller than the width of the distal end portion of the ultrasonic horn, the protective member can be shared with respect to the core wire in a predetermined range in which the width dimension after bonding is relatively large to the width dimension of the protective member. As a result, it is not necessary to prepare a protective member for each width dimension after bonding of the core wire, and the productivity of the electric wire with a terminal can be improved and the manufacturing cost can be reduced.

According to still another aspect of the electric wire with a terminal, it is desired that the protective member has a chamfered portion at an edge of a side surface facing the core wire.

In particular, when the width dimension of the protective member is smaller than the width dimension of the distal end portion of the ultrasonic horn, the core wire may be pressed by the both side edges of the protective member in a direction parallel to the core wire. Therefore, by providing the chamfered portion on the side surface facing the core wire of the protective member, stress concentration due to the edges on both sides of the protective member can be suppressed, and damage to the core wire can be suppressed even in a direction parallel to the core wire.

In still another aspect of the electric wire with a terminal, the dimension of the protective member is set to be larger than the dimension of the distal end portion of the horn that is in contact with the protective member in the direction orthogonal to the core wire and orthogonal to the direction of the pressurization.

In this way, since the width dimension of the protective member is set to be larger than the width dimension of the distal end portion of the ultrasonic horn, the protective member can be shared with respect to the core wire in a predetermined range in which the width dimension after bonding is relatively small to the width dimension of the protective member. As a result, it is not necessary to prepare a protective member for each width dimension after bonding of the core wire, and the productivity of the electric wire with a terminal can be improved and the manufacturing cost can be reduced.

In still another aspect of the electric wire with a terminal, the dimension of the protective member is set to be larger than the dimension of the distal end portion of the ultrasonic horn that is in contact with the protective member in the direction parallel to the core wire.

Since the depth dimension of the protective member is set to be larger than the depth dimension of the distal end portion of the ultrasonic horn, there is no possibility that the distal end portion of the ultrasonic horn directly presses the core wire on the proximal end side of the core wire. As a result, the disconnection of the core wire can be effectively suppressed.

In still another aspect of the electric wire with a terminal, it is desired that the dimension of the protective member is set to be equal to or larger than the diameter of the strand of the core wire in the pressurization direction.

In this way, since the thickness dimension of the protective member is set to be at least equal to or larger than the diameter of the strand of the core wire, the protective member can bear a shearing force that can be received by each strand of the core wire from at least the distal end portion of the ultrasonic horn. In other words, the protective member can secure rigidity that can bear the shearing force that can be received by each strand of the core wire from the pressing portion of the ultrasonic horn. Thus, disconnection of the core wire can be effectively suppressed by the protective member.

In still another aspect of the electric wire with a terminal, it is desired that the protective member is formed of the same material as the core wire.

In this way, since the protective member is formed of the same material as the core wire, good connectivity between the protective member and the core wire by the ultrasonic bonding can be obtained, and the protective member and the core wire can be firmly connected.

From another point of view, the present invention is a method of manufacturing an electric wire with a terminal in which a core wire exposed from an end of an electric wire and a terminal fitting are connected by ultrasonic bonding. In one aspect thereof, the method includes a step of placing the terminal fitting on an anvil, disposing the core wire on the terminal fitting, and disposing a protective member on the core wire, and a step of integrally connecting the protective member, the core wire and the terminal fitting by applying ultrasonic vibration by an ultrasonic horn disposed on the anvil via the protective member in a state in which the core wire is pressed against the terminal fitting via the protective member.

According to the present invention, since the core wire is ultrasonically bonded in a state of being sandwiched between the plate-like protective member and the terminal fitting, there is no possibility that the distal end portion of the ultrasonic horn directly presses the core wire at the time of ultrasonic bonding. That is, there is no possibility that the edge of the distal end portion of the ultrasonic horn is in direct contact with the core wire. As a result, stress concentration due to the edge of the distal end portion of the ultrasonic horn with respect to the core wire at the time of ultrasonic bonding is relaxed, and disconnection of the core wire can be suppressed.

DESCRIPTION OF EMBODIMENTS

Hereafter, embodiments of an electric wire with a terminal and a method of manufacturing the same according to the present invention will be described below with reference to the drawings.

(Configuration of Electric Wire With Terminal)

A specific configuration of the electric wire with a terminal according to the present embodiment will be described in detail with reference to FIGS. 1 to 4.

Figure 1:
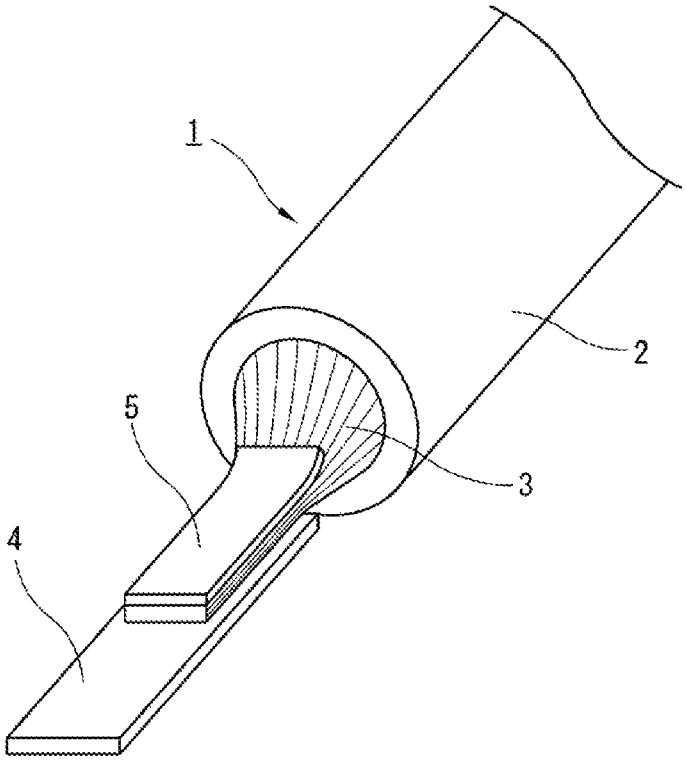
FIG. 1 is a perspective view of an electric wire with a terminal according to a first embodiment of the present invention.

As shown in FIG. 1, in the electric wire with a terminal according to the present embodiment, ultrasonic bonding is performed in a state in which a core wire 3 exposed by removing an insulating coating 2 at the terminal of an electric wire 1 is sandwiched between a protective member 5 and a terminal fitting 4. Thus the protective member 5, the core wire 3, and the terminal fitting 4 are integrally connected (bonded).

The electric wire 1 is an aluminum electric wire in which the core wire 3 is formed of, for example, a stranded wire of aluminum. Then, the insulating coating 2 in a predetermined range of the terminal of the electric wire 1 is removed, and the distal end portion of the core wire 3 thus exposed is connected (bonded) to the proximal end portion of the terminal fitting 4 by ultrasonic bonding. Specifically, the connection region (ultrasonic bonding region) with the terminal fitting 4 is squashed in a substantially rectangular plate shape along the terminal fitting 4 by being pressurized with the ultrasonic bonding. The electric wire 1 may be an electric wire made of another conductive metal material, such as a copper electric wire in which the core wire 3 is formed of copper, for example, in addition to the aluminum electric wire. In addition, the electric wire 1 may be formed of a copper alloy or an aluminum alloy. The electric wire 1 may be formed by performing plating (for example, Sn, Ni, or the like) to a copper wire or an aluminum wire, or may be formed by adding a carbon nanotube to a conductive material such as copper or aluminum.

The terminal fitting 4 is formed in a substantially flat plate shape by a conductive metal material, such as copper or aluminum. Although the terminal fitting 4 is formed in a simple plate shape by the illustration of FIG. 1, the present invention is not limited thereto. In other words, in addition to the plate-like member, for example, the terminal fitting 4 may be one having a so-called round or Y-shaped terminal connection portion formed integrally with the distal end portion, and the terminal fitting 4 itself may be configured as a wiring member.

The protective member 5 is formed of aluminum, which is the same material as the core wire 3 of the electric wire 1, and is formed in a substantially flat plate shape. More specifically, the protective member 5 is formed in a rectangular plate shape having a rectangular shape in both a plan view and a cross section. The protective member 5 is not necessarily limited to the same material as the core wire 3 of the electric wire 1, and may be formed of a material different from the material of the core wire 3 of the electric wire 1. Specifically, for example, the protective member 5 made of aluminum may be used for the copper wire.

In addition to the aluminum, the protective member 5 may be formed of another conductive metal such as copper. At this time, the material of the protective member 5 may be not only pure aluminum or pure copper, but also an alloy thereof (aluminum alloy or copper alloy), for example, and may be plated (for example, Sn, Ni or the like) on aluminum or copper. In addition, the protective member 5 may be formed by adding carbon nanotubes to a conductive material such as aluminum or copper.

Further, the protective member 5 may be formed of not only a metal material, but also a resin material, for example. That is, the resin material can be applied as the material of the protective member 5 as long as the resin material can be connected to the core wire 3 without being welded to an ultrasonic horn 7 (see FIG. 2) described later by ultrasonic bonding.

Figure 3:
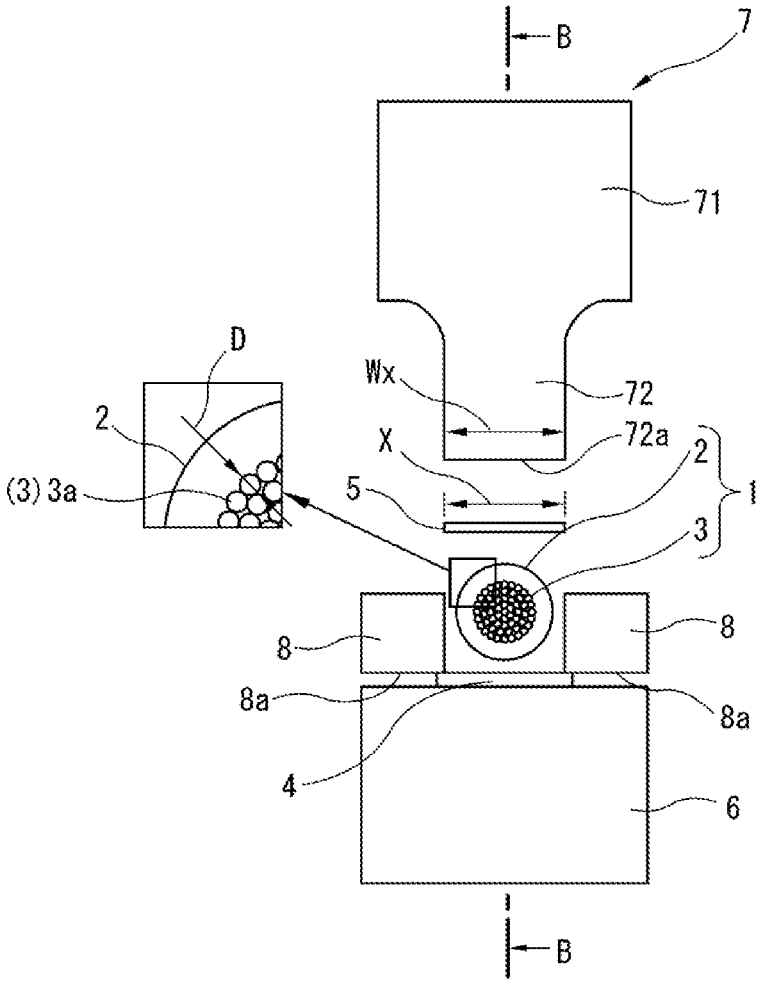
FIG. 3 is an arrow view of FIG. 2 as viewed from the direction A.

Further, as shown in FIG. 3, the dimension in the direction orthogonal to the core wire 3 of the protective member 5 (hereinafter abbreviated as "width dimension") X is set to be substantially the same as the width dimension Wx of a pressing portion 72 of the ultrasonic horn 7 described later. More specifically, when the width dimension of the pressing portion 72 of the ultrasonic horn 7 is Wx and the diameter of the strand of the core wire 3 (one metal wire constituting the core wire 3) 3*a* is D, the width dimension X of the protective member 5 is set to satisfy "$(Wx-D) \leq X \leq Wx$". That is, the width dimension X of the protective member 5 is equal to or larger than the width dimension Wx of the pressing portion 72 of the ultrasonic horn 7 minus the diameter D of the strands 3*a* of the core wire 3 and is equal to or smaller than the width dimension Wx of the pressing portion 72 of the ultrasonic horn 7.

Furthermore, when the dimension in the direction parallel to the core wire 3 of the protective member 5 (hereinafter abbreviated as "depth dimension") Y is set to be satisfy "$Wy \leq Y$" when Wy represents the depth dimension of the pressing portion 72 of the ultrasonic horn 7 described later. That is, the depth dimension Y of the protective member 5 is set to be equal to or larger than the depth dimension Wy of the pressing portion 72 of the ultrasonic horn 7.

In addition, a dimension in a direction orthogonal to the core wire 3 of the protective member 5 and parallel to a direction in which the ultrasonic horn 7 is moved up and down (hereinafter, abbreviated as a "thickness dimension") Z is set to satisfy "$D \leq Z$" when D represents the diameter of the strand 3*a* of the core wire 3. That is, the thickness dimension Z of the protective member 5 is set to be equal to or larger than the diameter D of the wire 3*a* of the core wire 3.

(Method of Manufacturing Electric Wire With Terminal)

Before describing a method of manufacturing an electric wire with a terminal, an ultrasonic bonding device used for ultrasonic bonding of the electric wire with a terminal will be described with reference to FIGS. 2 to 4.

Figure 2:
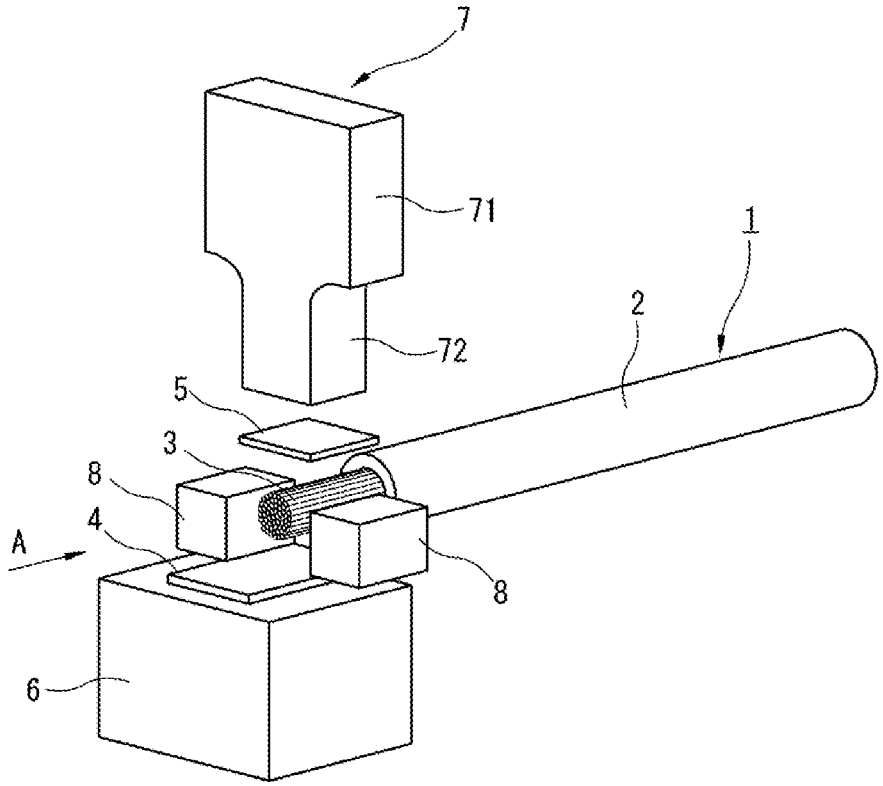
FIG. 2 is a perspective view showing a state before ultrasonic bonding of the electric wire with a terminal according to the first embodiment of the present invention.
Figure 4:
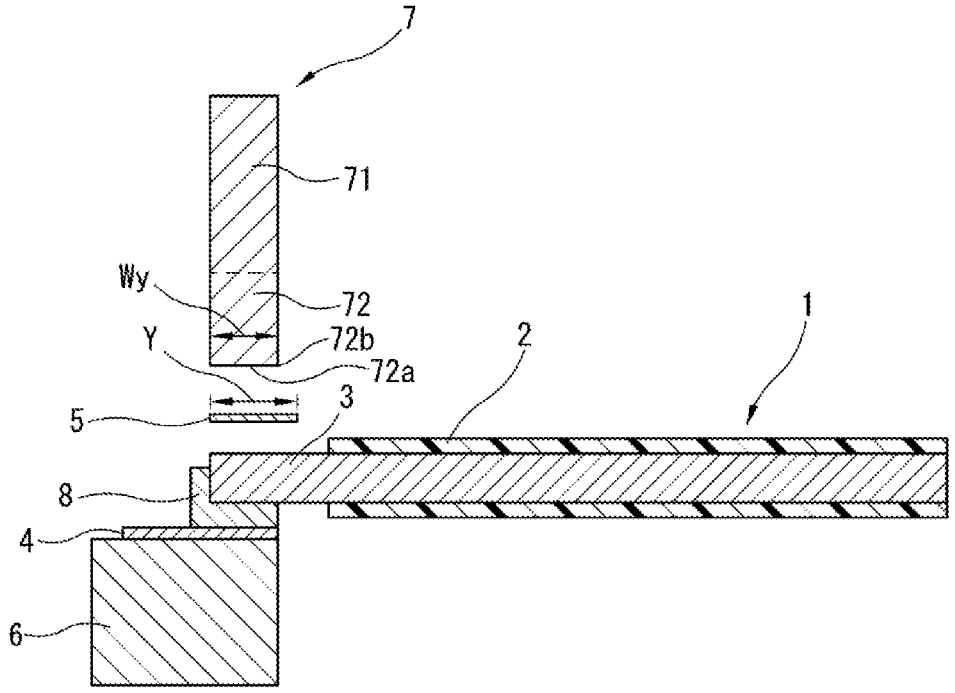
FIG. 4 is a cross-sectional view taken along line B-B of FIG. 3.

As shown in FIGS. 2 to 4, the ultrasonic bonding device includes an anvil 6 serving as a pedestal having a substantially smooth upper surface, an ultrasonic horn 7 provided so as to be movable up and down above the anvil 6, and a pair of clamp members 8 which hold and clamp (fix) both side edges of the terminal fitting 4 on the anvil 6.

The ultrasonic horn 7 includes a horn body 71 formed in a relatively wide width and a pressing portion 72 corresponding to the distal end portion of the ultrasonic horn 7 in the present invention which is formed in a stepped manner at the distal end portion of the horn body 71 and presses the core wire 3 against the terminal fitting 4 via the protective member 5. That is, the ultrasonic horn 7 sandwiches the terminal fitting 4, the core wire 3, and the protective member 5 to be bonded between the anvil 6 and the ultrasonic horn 7, and applies ultrasonic vibration by pressing the core wire 3 against the terminal fitting 4 via the protective member 5 by the pressing portion 72.

The clamp members 8, 8 have a substantially rectangular block shape, and are disposed with an interval (span) slightly wider than the width dimension Wx of the pressing portion 72 of the ultrasonic horn 7, and are provided so as to be able to move up and down in the vertical direction in the same manner as the ultrasonic horn 7. That is, the clamp members 8, 8 are unclamped in the raised state, and the terminal fitting 4 is fixed on the anvil 6 by clamping the outer edge of the terminal fitting 4 by the inner edges of the lower surfaces 8*a*, 8*a* in the lowered state.

Hereinafter, a method of manufacturing the electric wire with a terminal according to the present embodiment will be described in detail with reference to FIGS. 2 to 5. In the description of the drawings, for convenience, the distal end side of the core wire 3 is described as "front" and the proximal end side of the core wire 3 is referred to as "rear".

First, as shown in FIGS. 2 to 4, the terminal fitting 4 is placed on the anvil 6 and clamped. Thereafter, the core wire 3 exposed by removing the insulation coating 2 of the terminal of the electric wire 1 is inserted between the pair of clamp members 8, 8, and then disposed on the proximal end portion of the terminal fitting 4, and then the protective member 5 is disposed on the core wire 3 inserted between the clamp members 8, 8.

Figure 5A:
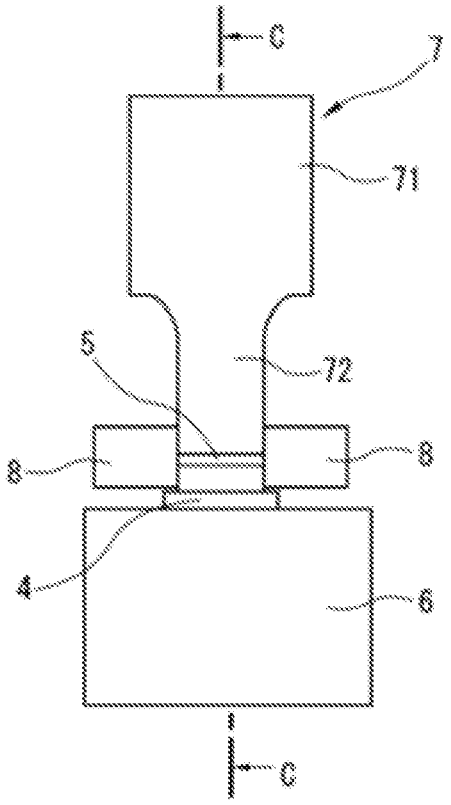
FIG. 5A is an arrow view corresponding to FIG. 3 showing a state after ultrasonic bonding.
Figure 5B:
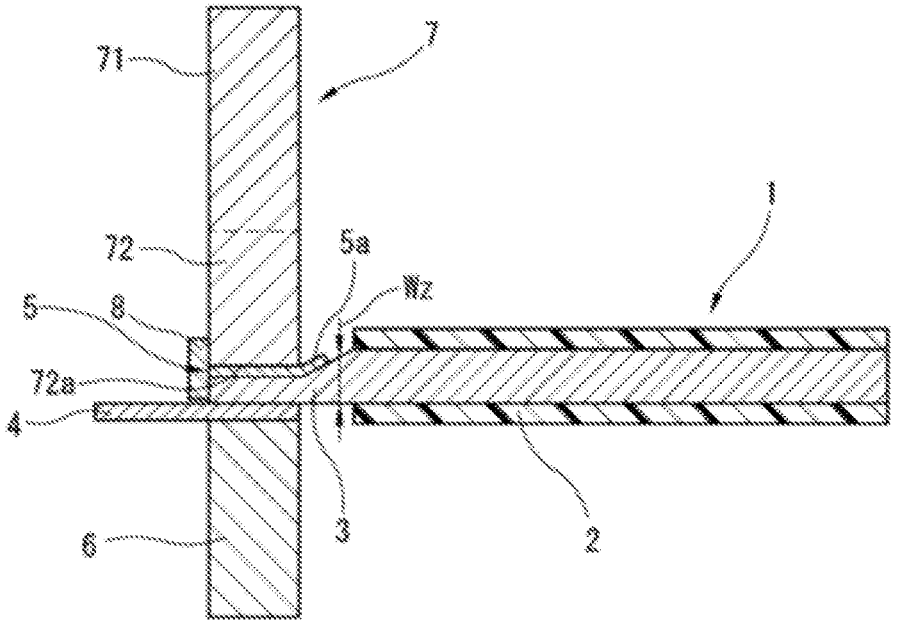
FIG. 5B is a cross-sectional view taken along line C-C of FIG. 5A.

Subsequently, as shown in FIGS. 5A and 5B, ultrasonic vibration is applied to the protective member 5, the core wire 3, and the terminal fitting 4 in a state where the ultrasonic horn 7 is lowered and the core wire 3 is pressed against the terminal fitting 4 by the pressing portion 72 of the ultrasonic horn 7. At this time, in a state where the entire pressing surface 72*a* facing the protective member 5 including the edge orthogonal to the core wire 3, particularly the rear edge 72*b* (see FIG. 4), in the pressing portion 72 of the ultrasonic horn 7 is not in direct contact with the core wire 3 but in contact with protective member 5, the core wire 3 is pressurized via the protective member 5.

When the ultrasonic vibration is applied with the pressurization, the protective member 5, the core wire 3, and the terminal fitting 4 are integrally connected, and the electric wire with a terminal is completed. Specifically, as shown in FIGS. 5A and 5B, among the protective member 5 and the core wire 3, in the ultrasonic connection region to which ultrasonic vibration is applied by being pressurized by the pressing portion 72 of the ultrasonic horn 7, the protective member 5 and the core wire 3 are squashed into a flat shape and are integrally connected by the pressing surface 72*a* of the ultrasonic horn 7. On the other hand, in the non-connection region which is a region on the rear end side of the ultrasonic connection region, the core wire 3 is formed in a tapered shape such that the thickness Wz gradually decreases toward the front end side, and a rear end portion 5*a* of the protective member 5 protruding from the pressing surface 72*a* of the ultrasonic horn 7 is bent along the tapered core wire 3. Finally, by raising the ultrasonic horn 7 and unclamping both the clamp members 8, 8, the electric wire with a terminal is taken out, and the manufacture of the electric wire with a terminal is completed.

Effects of Embodiment

Hereinafter, the effects of the electric wire with a terminal according to the embodiment will be described in detail.

Figure 12:
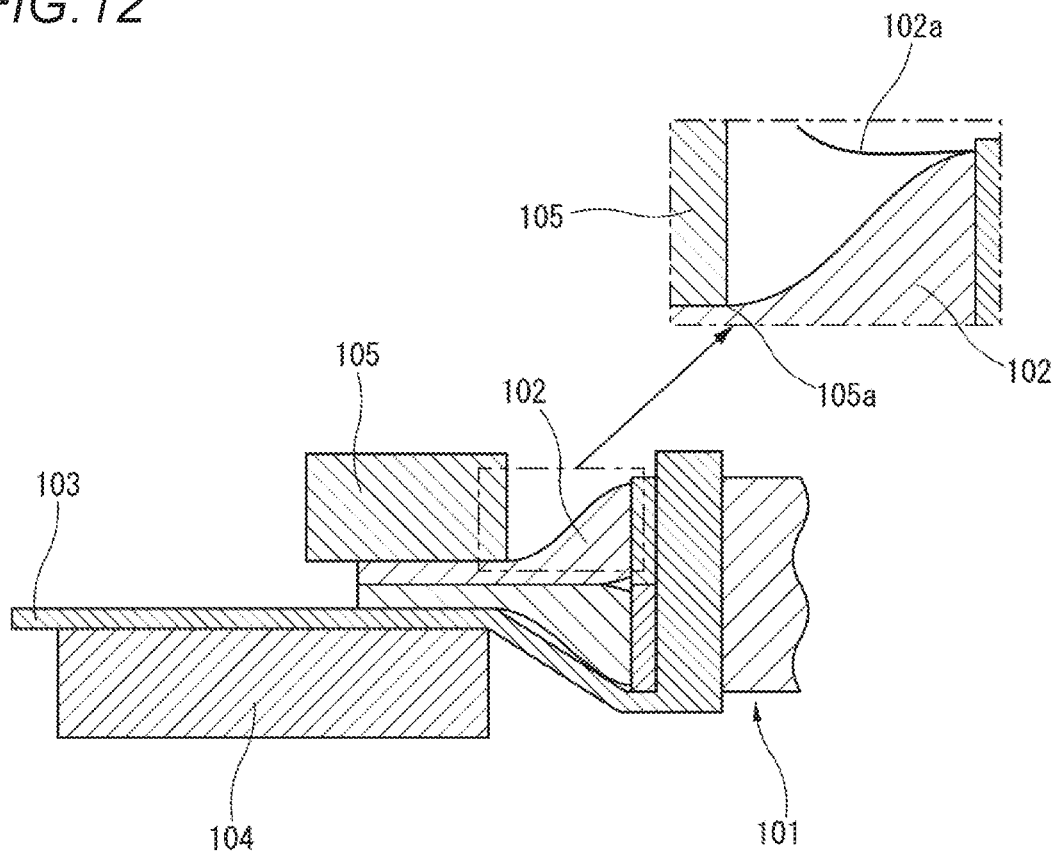
PRIOR ART FIG. 12
FIG. 12 is a cross-sectional view showing a state of a conventional electric wire with a terminal in ultrasonic bonding.

According to the conventional method for manufacturing an electric wire with a terminal, as shown in FIG. 12, an edge 105*a* of the ultrasonic horn 105 directly contacts the core wire 102. Therefore, at the time of pressurization in the ultrasonic bonding, stress concentration due to the edge 105*a* of the ultrasonic horn 105 may occur in the shear direction of the core wire 102, and a part (strand) 102*a* of the core wire 102 may be disconnected (see a partially enlarged view in FIG. 12).

In contrast, according to the electric wire with a terminal and the method of manufacturing the same according to the present embodiment, the protective member 5, the core wire 3, and the terminal fitting 4 are connected to each other by ultrasonic vibration applied via the protective member 5 in a state in which the core wire 3 is sandwiched between the protective member 5 and the terminal fitting 4. In other words, at the time of ultrasonic bonding, the core wire 3 is pressurized by the ultrasonic horn 7 that applies ultrasonic vibration via the protective member 5 in a state of being protected by the protective member 5. Therefore, there is no possibility that the ultrasonic horn 7 directly presses the core wire 3, and the edge (particularly, the rear edge 72*b*) of the pressing portion 72 of the ultrasonic horn 7 is direct in contact with the core wire 3. As a result, at the time of ultrasonic bonding, stress concentration due to the edge (particularly the rear edge 72*b*) of the pressing portion 72 of the ultrasonic horn 7 with respect to the core wire 3 can be relaxed, and disconnection of the core wire 3 can be suppressed.

In the present embodiment, since the width dimension X of the protective member 5 is set to be substantially the same as the width dimension Wx of the pressing portion 72 of the ultrasonic horn 7, the core wire 3 can be protected without excess or deficiency in the width direction of the protective member 5. As a result, the core wire 3 is not damaged due to the shortage of the width dimension X of the protective member 5, and the surplus material of the protective member 5 can be reduced.

Further, in the present embodiment, the lower limit of the width dimension of the protective member 5 is obtained by subtracting the diameter D of strands 3*a* of the core wire 3 from the width dimension Wx of the pressing portion 72 of the ultrasonic horn 7. Therefore, in the width direction of the protective member 5, the strands 3*a* (all the strands 3*a*) constituting the core wire 3 overlaps with the protective member 5, and the strands 3*a* do not protrude from the protective member 5. As a result, the disconnection of the core wire 3 can be effectively suppressed.

In addition, in the present embodiment, since the upper limit of the width dimension of the protective member 5 is set to the width dimension Wx of the pressing portion 72 of the ultrasonic horn 7, the surplus portion of the protective member 5 is reduced, and the yield of the material of the protective member 5 can be improved. As a result, the manufacturing cost of the electric wire with a terminal can be reduced.

In the present embodiment, since the depth dimension Y of the protective member 5 is set to be larger than the depth dimension Wy of the pressing portion 72 of the ultrasonic horn 7, there is no possibility that the pressing portion 72 (particularly, the rear edge 72*b*) of the ultrasonic horn 7 directly presses the core wire 3 on the proximal end side of the core wire 3. As a result, the disconnection of the core wire 3 can be more effectively suppressed.

Further, in the present embodiment, since the thickness dimension Z of the protective member 5 is set to be at least equal to or more than the diameter D of the strand 3*a* of the core wire 3, the protective member 5 can bear the shearing force that can be received by each strand 3*a* of the core wire 3 at least from the pressing portion 72 of the ultrasonic horn 7. In other words, the protective member 5 can secure rigidity that can bear the shearing force that can be received by each strand 3*a* of the core wire 3 from the pressing portion 72 of the ultrasonic horn 7. As a result, the disconnection of the core wire 3 can be further effectively suppressed by the protective member 5.

Further, in the present embodiment, since the protective member 5 is formed of the same material as the core wire 3, good connection between the protective member 5 and the core wire 3 by ultrasonic bonding can be obtained, and the protective member 5 and the core wire 3 can be connected more firmly.

(Modifications)

Figure 6A:
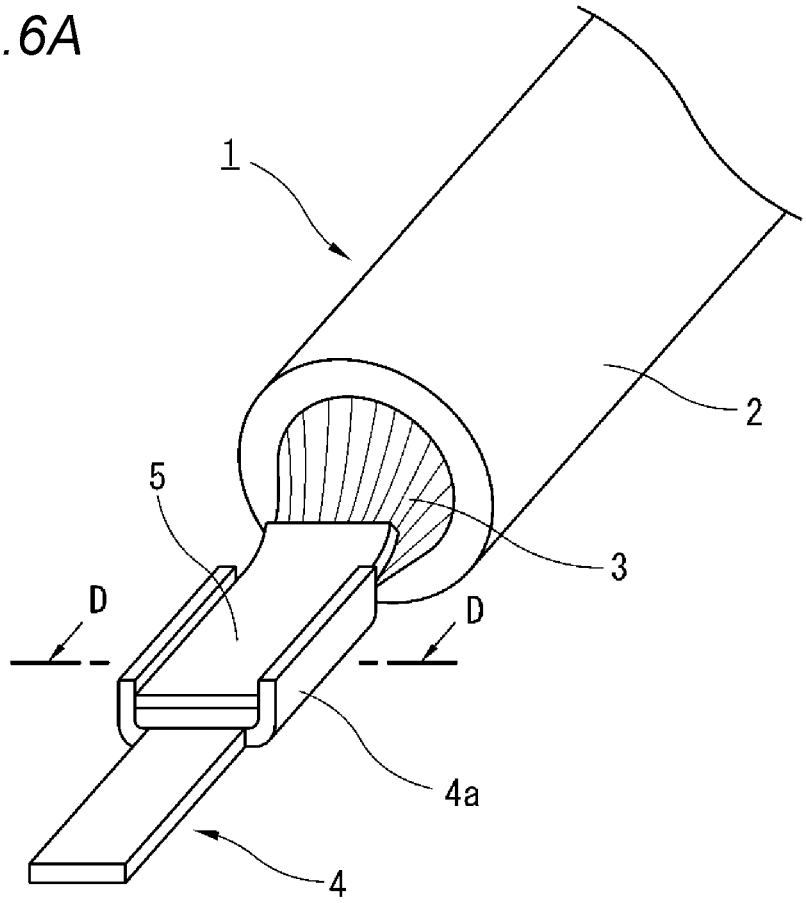
FIG. 6A is a perspective view of an electric wire with a terminal according to a modification of the first embodiment of the present invention.
Figure 6B:
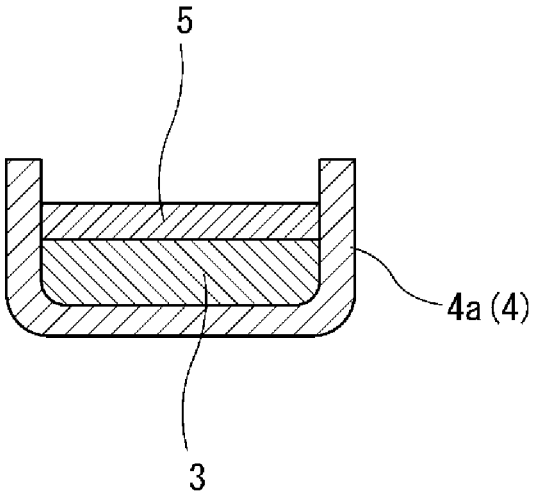
FIG. 6B is a cross-sectional view taken along line D-D of FIG. 6A.

Although the terminal fitting 4 is simply formed in a flat plate shape in the present embodiment, as shown in FIGS. 6A and 6B, the terminal fitting 4 may have an ultrasonic connection region, that is, a connection region 4*a* with the core wire 3 formed in a U shape in cross section.

As described above, since the connection region 4*a* with the core wire 3 is formed in a U shape in cross section, ultrasonic bonding can be performed in a state in which positional deviation in the width direction of the core wire 3 and the protective member 5 is suppressed, and the productivity and quality of the electric wire with a terminal can be improved.

Second Embodiment

Figure 7A:
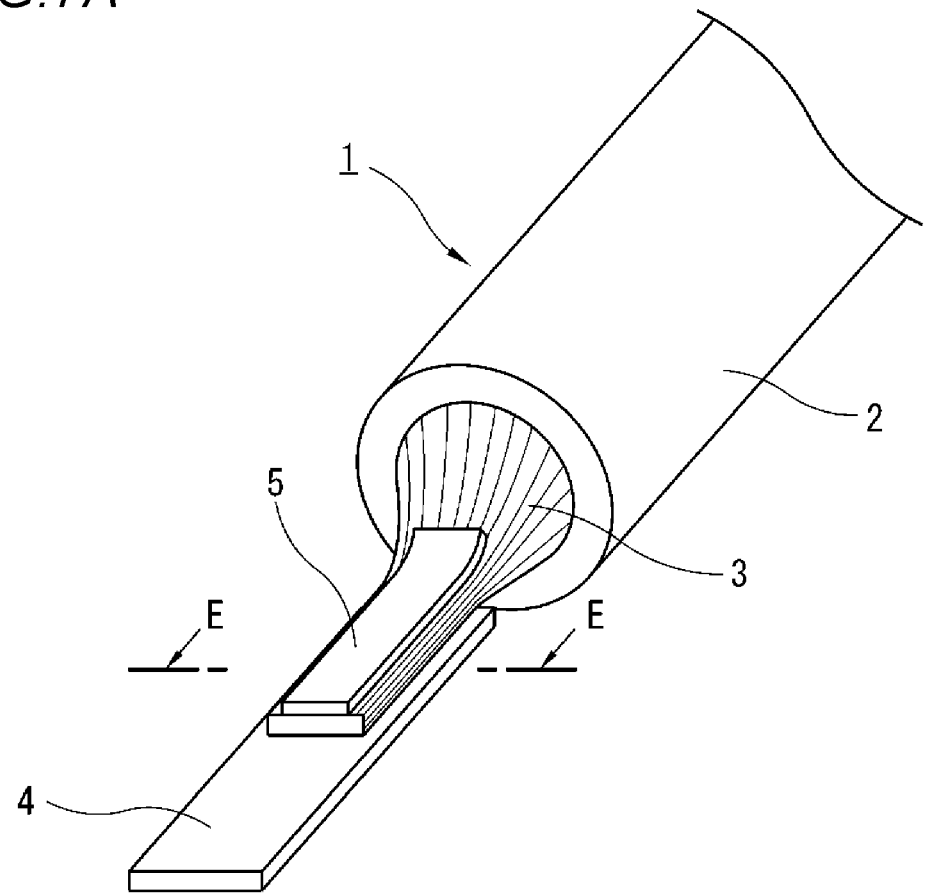
FIG. 7A is a perspective view of an electric wire with a terminal according to a second embodiment of the present invention.
Figure 7B:
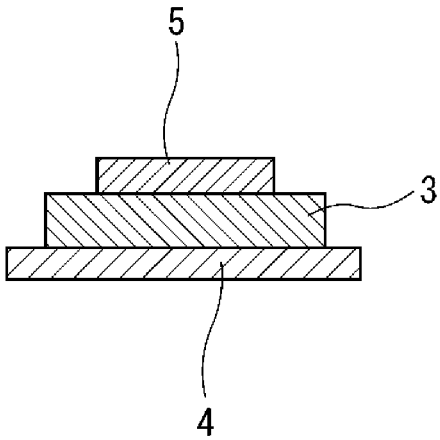
FIG. 7B is a cross-sectional view taken along line E-E of FIG. 7A.
Figure 8:
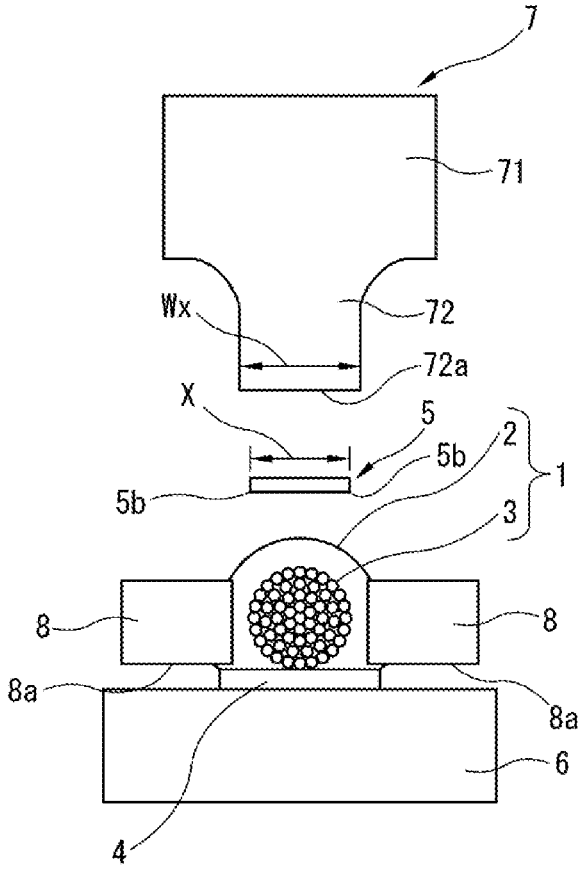
FIG. 8 is a front view showing a state before ultrasonic bonding of the electric wire with a terminal according to the second embodiment of the present invention.

FIGS. 7A, 7B and 8 show a second embodiment of an electric wire with a terminal and a method of manufacturing the same according to the present invention. In the present embodiment, the configuration of the protective member 5 according to the first embodiment is modified, and the other configuration is the same as that of the first embodiment. Therefore, the same components as those in the first embodiment are denoted by the same reference numerals, and a description thereof will be omitted.

As shown in FIGS. 7A, 7B and 8, in the present embodiment, the width dimension X of the protective member 5 is set to be ⅔ or more of the width dimension Wx of the pressing portion 72 of the ultrasonic horn 7 and smaller than the width dimension Wx of the pressing portion 72 of the ultrasonic horn 7. In a side surface facing the core wire 3 of the protective member 5, a chamfered portion 5*b* having, for example, an R tapered shape (arc shape in cross section) is formed on the both side edges in the width direction (X direction). The chamfered portion 5*b* may be formed not only in the R tapered shape but also in, for example, a chamfered shape (linear in cross section).

Here, when the core wire 3 is squashed by the ultrasonic horn 7 at the time of pressurization accompanying the ultrasonic bonding, stress concentration is likely to occur in a region in the width direction (X direction) having a large crushing margin, that is, in the central portion of the pressing portion 72 of the ultrasonic horn 7 and in a region of ⅔ of the width dimension Wx of the pressing portion 72.

Therefore, in the present embodiment, the lower limit of the width dimension of the protective member 5 is set to ⅔ of the width dimension Wx of the pressing portion 72 of the ultrasonic horn 7. As a result, the region where the stress concentration is likely to occur with the protective member 5 can be protected while suppressing the material cost of the protective member 5. As a result, disconnection of the core wire 3 can be suppressed and the manufacturing cost (material cost of the protective member 5) can be reduced.

Further, in the present embodiment, since the width dimension X of the protective member 5 is set to be equal to or larger than ⅔ of the width dimension Wx of the pressing portion 72 of the ultrasonic horn 7 and smaller than the width dimension Wx of the pressing portion 72 of the ultrasonic horn 7, the protective member 5 can be shared with respect to the core wire 3 in a predetermined range in which the width dimension after bonding is relatively large. Accordingly, it is not necessary to manufacture the protective member 5 according to the width dimension after the bonding of the core wire 3 (for each width dimension after bonding), and the productivity of the electric wire with a terminal can be improved and the manufacturing cost can be reduced.

As described above, in the present embodiment in which the width X of the protective member 5 is set to be smaller than the width Wx of the pressing portion 72 of the ultrasonic horn 7, the both side edges of the protective member 5 may press the core wire 3 in a direction parallel to the core wire 3.

Therefore, in the present embodiment, the chamfered portion 5*b* is provided on the both side edges in the width direction (X direction) of the side surface facing the core wire 3 of the protective member 5. Accordingly, stress concentration due to both side edges in the width direction (X direction) of the protective member 5 can be suppressed, and damage to the core wire 3 can be suppressed in the direction parallel to the core wire 3 as well.

(Modifications)

Figure 9A:
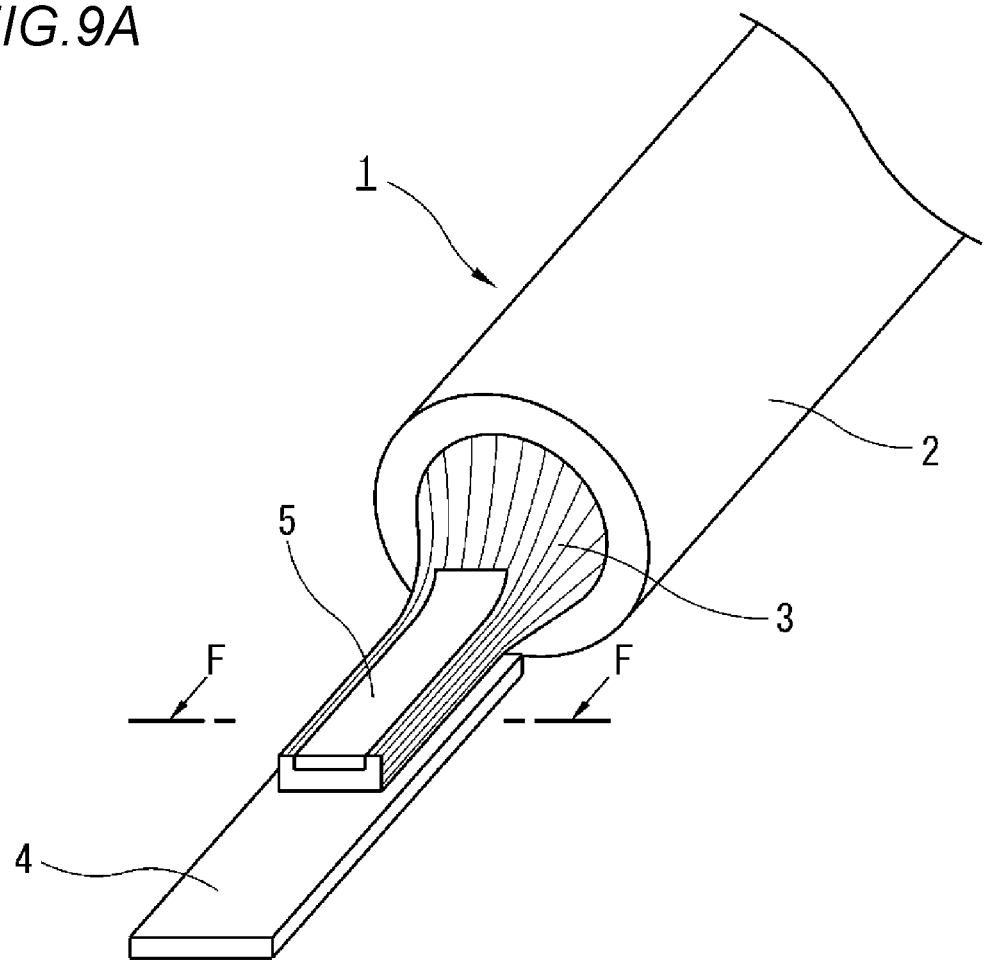
FIG. 9A is a perspective view of an electric wire with a terminal according to a modification of the second embodiment of the present invention.
Figure 9B:
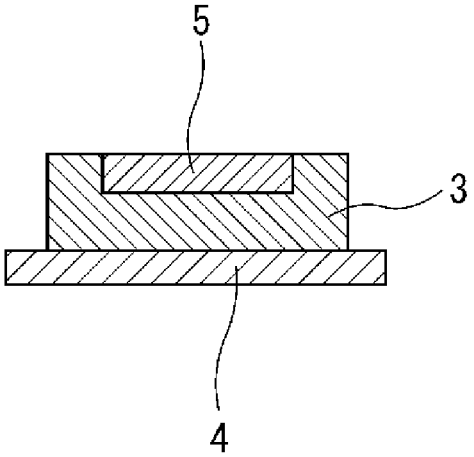
FIG. 9B is a cross-sectional view taken along line F-F in FIG. 9A.

Although the compression margin of the core wire 3 is relatively small and the protective member 5 is laminated on the core wire 3 in the present embodiment, for example, as shown in FIGS. 9A and 9B, the compression margin of the core wire 3 by the ultrasonic horn 7 may be large until the protective member 5 is embedded in the concavely deformed core wire 3.

Third Embodiment

Figure 10:
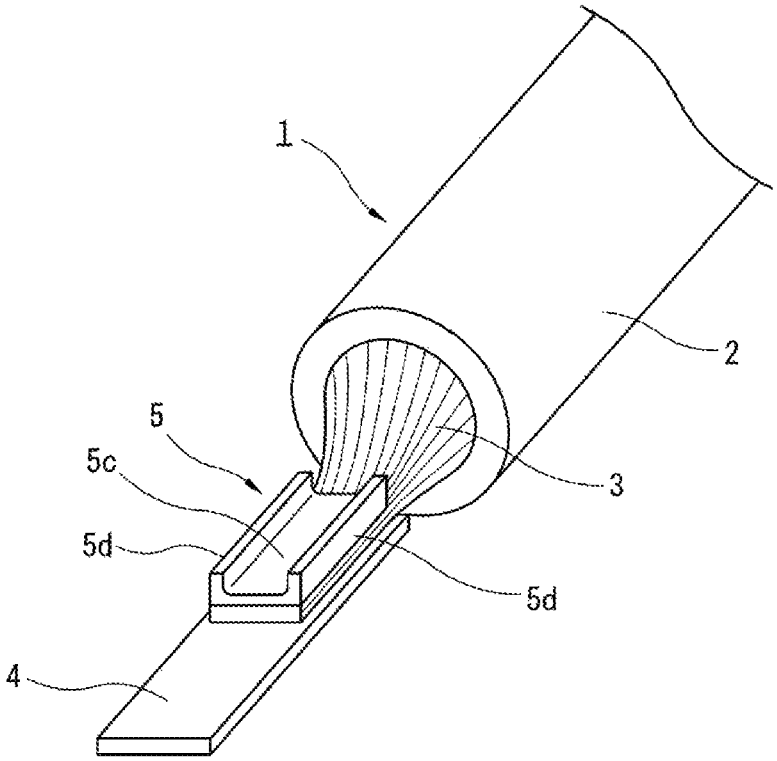
FIG. 10 is a perspective view of an electric wire with a terminal according to a third embodiment of the present invention.
Figure 11:
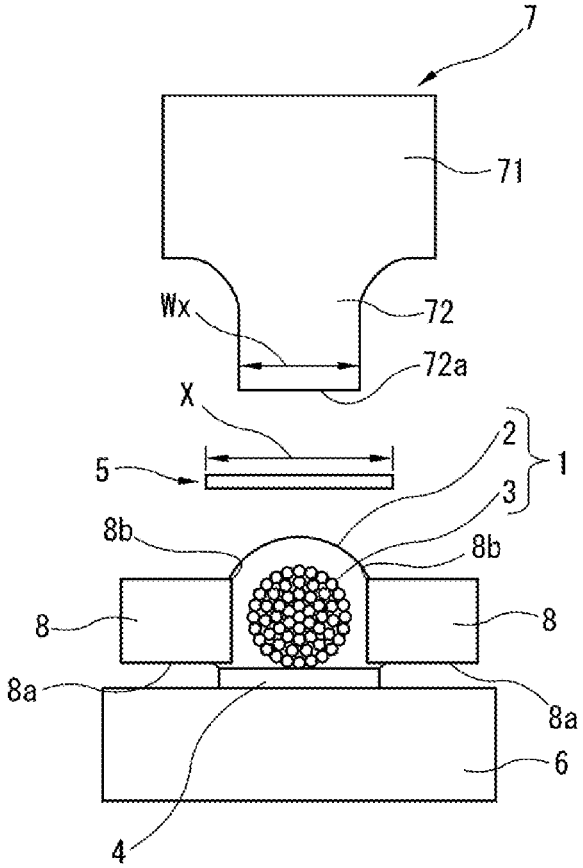
FIG. 11 is a front view showing a state before ultrasonic bonding of the electric wire with a terminal according to the third embodiment of the present invention.

FIGS. 10 and 11 show an electric wire with a terminal according to a third embodiment of the present invention. In the present embodiment, the configuration of the protective member 5 according to the first embodiment is modified, and the other configuration is the same as that of the first embodiment. Therefore, the same components as those in the first embodiment are denoted by the same reference numerals, and a description thereof will be omitted.

As shown in FIGS. 10 and 11, in the present embodiment, the width dimension X of the protective member 5 is set to be larger than the width dimension Wx of the pressing portion 72 of the ultrasonic horn 7. On the basis of the dimensional difference, the surplus side portions 5*d*, 5*d* of the protective member 5 which exceed the width dimension Wx of the pressing portion 72 of the ultrasonic horn 7 are bent toward the side opposite to the core wire 3 (the pressing portion 72 side). That is, when the protective member 5 is pushed between the clamp members 8, 8 by the pressing portions 72 of the ultrasonic horn 7, the central flat portion 5*c* is connected (bonded) to the core wire 3 in a state where both side portions 5*d*, 5*d* are respectively sandwiched between the pressing portion 72 of the ultrasonic horn 7 and the inner upper edges 8*b*, 8*b* of the clamp members 8, 8 and bent to the opposite side with respect to the core wire 3 (pressing portion 72 side). In this way, the protective member 5 is bent in a concave shape along the outer shape of the distal end portion of the pressing portion 72 of the ultrasonic horn 7 by the ultrasonic horn 7, and the central flat portion 5*c* is integrally connected to the core wire 3 (see FIG. 10).

In the present embodiment, since the width dimension X of the protective member 5 is set to be larger than the width dimension Wx of the pressing portion 72 of the ultrasonic horn 7, the protective member 5 can be shared with respect to the core wire 3 in a predetermined range in which the width dimension after bonding is relatively small. Accordingly, it is not necessary to manufacture the protective member 5 according to the width dimension after the bonding of the core wire 3 (for each width dimension after bonding), and the productivity of the electric wire with a terminal can be improved and the manufacturing cost can be reduced.

The present invention is not limited to the configuration exemplified in the above embodiment, and can be freely changed according to the specification of the application target and the like without departing from the spirit of the present invention.

Further, in each of the embodiments described above, the plate-like member is illustrated and described as the protective member according to the present invention, but the present invention is not limited to such a plate-like one, and other forms such as one formed in a gentle arc shape may be adopted as long as ultrasonic bonding can be performed on the electric wire.

What is claimed is:

1. An electric wire with a terminal in which a core wire exposed from an end of the electric wire and the terminal are connected by ultrasonic bonding, the electric wire with the terminal comprising:

a plate shaped protective member for protecting the core wire having a rear end portion bent along the core wire, wherein the core wire is integrally connected to the protective member and the terminal by ultrasonic vibration applied in a pressurized state from an ultrasonic horn via the protective member in a state of being sandwiched between the protective member and the terminal.

2. The electric wire with the terminal according to claim 1, wherein the dimension of the protective member is set to be equal to or larger than the diameter of the strand of the core wire in the pressurization direction.

3. The electric wire with the terminal according to claim 1, wherein the protective member is formed of the same material as the core wire.

4. The electric wire with the terminal according to claim 1, wherein a dimension of the protective member is set to be substantially same as a dimension of a distal end portion of the ultrasonic horn that is in contact with the protective member in a direction orthogonal to the core wire and orthogonal to a pressurization direction.

5. The electric wire with the terminal according to claim 4, wherein the dimension of the protective member is equal to or larger than the dimension of the distal end portion of the ultrasonic horn that is in contact with the protective member minus a diameter of a strand of the core wire, and is equal to or smaller than the dimension of the distal end portion of the ultrasonic horn in the direction orthogonal to the core wire and orthogonal to the pressurization direction.

6. The electric wire with the terminal according to claim 1, wherein the dimension of the protective member is ⅔ or more of the dimension of the distal end portion of the ultrasonic horn that is in contact with the protective member, and is smaller than the dimension of the distal end portion of the ultrasonic horn in the direction orthogonal to the core wire and orthogonal to the pressurization direction.

7. The electric wire with the terminal according to claim 6, wherein the protective member has a chamfered portion at an edge of a side surface of the protective member facing the core wire.

8. An electric wire with a terminal in which a core wire exposed from an end of the electric wire and the terminal are connected by ultrasonic bonding, the electric wire with the terminal comprising:

a protective member for protecting the core wire, wherein the core wire is integrally connected to the protective member and the terminal by ultrasonic vibration applied in a pressurized state from an ultrasonic horn via the protective member in a state of being sandwiched between the protective member and the terminal, and wherein the dimension of the protective member is set to be larger than the dimension of the distal end portion of the ultrasonic horn that is in contact with the protective member in at least one of the direction orthogonal to the core wire and orthogonal to the pressurization direction and a direction parallel to the core wire.

9. A method of manufacturing an electric wire with a terminal in which a core wire exposed from an end of the electric wire and the terminal are connected by ultrasonic bonding, the method comprising:

placing the terminal on an anvil, disposing the core wire on the terminal, and disposing a plate shaped protective member on the core wire; and integrally connecting the protective member, the core wire and the terminal by applying ultrasonic vibration by an ultrasonic horn disposed on the anvil via the protective member in a state in which the core wire is pressed against the terminal via the protective member and a rear end portion of the protective member is bent along the core wire.

* * * * *